US010000857B2

(12) United States Patent
Dufresne

(10) Patent No.: US 10,000,857 B2
(45) **Date of Patent: *Jun. 19, 2018**

(54) SEGMENTED CAPPING BOARD AND CONTACT BAR ASSEMBLY AND METHODS IN HYDROMETALLURGICAL REFINING

(71) Applicant: PULTRUSION TECHNIQUE INC., Saint-Bruno (CA)

(72) Inventor: Robert P. Dufresne, Saint-Bruno (CA)

(73) Assignee: Pultrusion Technique Inc., Saint-Bruno (Quebec) (CA)

( * ) Notice: Subject to any disclaimer, the term of this patent is extended or adjusted under 35 U.S.C. 154(b) by 240 days.

This patent is subject to a terminal disclaimer.

(21) Appl. No.: 14/759,855

(22) PCT Filed: Jan. 10, 2014

(86) PCT No.: PCT/CA2014/050015

§ 371 (c)(1),
(2) Date: Jul. 8, 2015

(87) PCT Pub. No.: WO2014/107810

PCT Pub. Date: Jul. 17, 2014

(65) Prior Publication Data

US 2015/0354075 A1 Dec. 10, 2015

Related U.S. Application Data

(60) Provisional application No. 61/751,501, filed on Jan. 11, 2013.

(51) Int. Cl.
*C25C 7/00* (2006.01)
*C25C 7/02* (2006.01)
(Continued)

(52) U.S. Cl.
CPC ..... *C25C 7/02* (2013.01); *C25C 1/00* (2013.01); *C25C 3/00* (2013.01); *C25C 5/00* (2013.01); *C25C 7/00* (2013.01); *Y10T 29/49952* (2015.01)

(58) Field of Classification Search
CPC ..... C25C 7/00–7/08
(Continued)

(56) References Cited

U.S. PATENT DOCUMENTS 3,697,404 A * 10/1972 Paige ..... C25C 7/02 204/267
4,479,863 A * 10/1984 Honey ..... C25C 7/02 204/267
(Continued)

FOREIGN PATENT DOCUMENTS

CA 1201681 A1 3/1986
CN 101805911 A 8/2010
(Continued)

OTHER PUBLICATIONS

Extended European Search Report issued in European Patent Application No. 14738049.7 dated May 30, 2016.

*Primary Examiner* — Luan V Van
*Assistant Examiner* — Alexander W Keeling
(74) *Attorney, Agent, or Firm* — Baker & Hostetler LLP

(57) ABSTRACT

An assembly for use in refining metals includes two adjacent capping board segments defining a joint interface therebetween, a contact bar that may be a contact bar segment and is sized and configured to lay on the two capping boards and to span across the joint interface, and two engagement mechanisms provided on respective sides of the joint interface, to hold the capping board segments together. Each engagement mechanism may include a projecting anchor element and a retaining cavity sized and configured to receive a corresponding projecting anchor element. The
(Continued)

contact bar may include the projecting anchor elements and the capping board segments may include the retaining cavities. Methods and uses of such contact bars and capping board segments are also provided for hydrometallurgical refining operations.

15 Claims, 9 Drawing Sheets

(51) Int. Cl.
*C25C 1/00* (2006.01)
*C25C 3/00* (2006.01)
*C25C 5/00* (2006.01)

(58) Field of Classification Search
USPC ..... 204/297.01–297.16
See application file for complete search history.

(56) References Cited

U.S. PATENT DOCUMENTS

| | | | | |
|---|---|---|---|---|
| 6,342,136 | B1 | 1/2002 | Virtanen et al. | |
| 8,147,662 | B2 | 4/2012 | Dufresne | |
| 8,308,920 | B2 | 11/2012 | Ashford et al. | |
| 9,222,184 | B2 * | 12/2015 | Dufresne | C25C 7/00 204/297.01 |
| 2009/0152124 | A1 * | 6/2009 | Ashford | C25C 1/12 205/574 |
| 2010/0065423 | A1 * | 3/2010 | Dufresne | C25C 7/00 204/297.01 |
| 2012/0205254 | A1 | 8/2012 | Navarro et al. | |

FOREIGN PATENT DOCUMENTS

| | | | |
|---|---|---|---|
| WO | 2008/092248 | A1 | 8/2008 |
| WO | 2012/129700 | A1 | 10/2012 |
| WO | 2013006977 | A1 | 1/2013 |

* cited by examiner

SEGMENTED CAPPING BOARD AND CONTACT BAR ASSEMBLY AND METHODS IN HYDROMETALLURGICAL REFINING

REFERENCE TO RELATED APPLICATIONS

This application is the U.S. national stage of International Application No. PCT/CA2014/0500151, filed Jan. 10, 2014, which claims the priority of Canadian application No. 61751501, filed Jan. 11, 2013, the disclosures of which are incorporated herein by reference in their entireties.

FIELD

The present technology generally relates to the field of hydrometallurgy and more particularly to capping board and contact bars for use in electrolytic cells.

BACKGROUND

In the hydrometallurgical industry, it is of common practice to refine metal by electrolysis in electrolytic cells especially designed for this purpose. The metals to be refined are usually conventional metals such as copper, zinc, nickel or cadmium, or precious metals such as silver, platinum or gold, and others.

It is also of common practice to use metal plates as anodes or cathodes or both. These metal plates often weight several hundred pounds. Usually, the metal to be refined, or the metal used to carry the electric current, is in the form of plates of a given thickness, which are provided at their upper end with two laterally extending projections, called hanging legs. Such projections facilitate gripping, handling and hanging of the plates on lateral sidewalls of the cells. These projections also serve to electrically contact or insulate the electrode.

In use, the electrode plates which, as mentioned, can each weigh several hundred pounds, are immersed into the cells in parallel relationship and are used as anodes, cathodes or both, depending on the affinity of the metal being refined.

In order to have the electrodes positioned in a precise desired location, it is of common practice to place a component called a "capping board" or a "bus bar insulator" onto the top surface of each lateral sidewall of the cells. These capping boards are used to position the plates with respect to each other. They are also used as electric insulators between adjacent cells and/or the electrodes and/or the ground.

In practice, the capping boards are used not only as supports to position the electrodes, but also as supports to avoid damage to the masonry, concrete or polymer-concrete forming the lateral side walls of the cells during the insertion and removal of the heaving electrodes. They are also used for electrolytic refining and electrowinning of metals. Capping boards are further used in combination with electrically conductive "contact bars", the purpose of which is to allow electrical connection between the ends of the anodes and cathodes located in adjacent cells. Thus, the combined use of capping boards and contact bars allows both insulation and distribution of electric current.

To achieve proper electrical contact with the contact bar, the plates forming the electrodes are provided with support hanging legs externally projecting on their opposite upper ends. Only one end of the legs of each plate is in contact with a contact bar on one side of the cell where it is located. The other leg of the same plate is held onto the capping board located on the opposite side of the cell in such a way as to be insulated. Thus, the capping board per se plays the role of an insulator and is thus made of insulating material. The contact bar usually extends over the full length of the corresponding capping board in order to connect altogether all the anodes of one cell to all the cathodes of the adjacent cell and vice versa. The contact bar may interconnect all of the cathodes to the anodes on other adjacent cells or perform other electric connection function between electrodes as desired.

In hydrometallurgical refining of metals, there are two main configurations that may be used to support the electrodes: symmetrical configurations using symmetrical anodes and cathodes and asymmetrical configurations using asymmetrical anodes and cathodes. The capping boards and contact bars are provided depending on the type of electrodes to be used. Thus, different capping board and contact bar systems will be used for symmetrical and asymmetrical electrodes.

Additionally, capping boards may be designed to receive one or more contact bars arranged in a parallel relationship. For example, a capping board may be provided with a primary contact bar and a secondary contact which are supplied with two different electric power sources. The primary contact bar may contact anodes and the secondary contact bar may contact cathodes, or vice-versa. Electrolytic cells including three or more contact bars may also be used in electrolytic refinery of metals, such as described in patent documents U.S. Pat. No. 8,308,920, U.S. Pat. No. 6,342,136 and CA 1.201.681.

So far, it has been of common practice to use capping boards made as a one piece structure extending over the full length of the electrolytic cell. Disadvantages and problems with such capping boards may be related to manufacturing and transportation cost, lack of ease during maintenance or replacement, and waste of the whole capping board in case of local wear or damage.

There is indeed a need in the industry for a contact board, capping board and electrode support technology that would overcome at least some of the aforementioned disadvantages and challenges.

SUMMARY

In some implementations, there is provided a capping board and contact bar assembly, comprising:

- two adjacent capping board segments arranged in end-to-end relation and defining a joint interface there-between, each capping board comprising:
  - a main elongated body;
  - two opposed rows of protrusions extending upwardly from the main elongated body for providing support and/or electric insulation for hanging arms of electrodes, the two opposed rows of protrusions being spaced to define a central elongated channel and adjacent protrusions of a same row being spaced apart to define a lateral channel for allowing passage of a corresponding hanging arm of an electrode; and
  - a projecting anchor element extending upwardly from the central channel; and
- a contact bar that is sized and configured to lay on the central elongated channel of the two capping boards and to span across the joint interface, the contact bar supporting and providing electrical contact with hanging arms of electrodes, and comprising:
  - two retaining cavities provided on opposed sides of the joint interface and being sized and configured to receive respective projecting anchor elements of the two adjacent capping board segments and cooperating such that the contact bar holds the two capping board segments together.

In some implementations, the projecting anchor elements of the capping board segments are located close to the joint interface.

In some implementations, the projecting anchor elements of the capping board segments are located from 1 to 20 centimeters away from the joint interface.

In some implementations, the projecting anchor elements of the capping board segments are located equidistant away from the joint interface.

In some implementations, each of the projecting anchor elements is generally parallelepiped shaped.

In some implementations, each of the projecting anchor elements comprises upper edges that are beveled.

In some implementations, each of the projecting anchor elements comprises lower edges that are beveled.

In some implementations, each of the retaining cavities has a corresponding shape with respect to the corresponding projecting anchor element engaged therewith.

In some implementations, the retaining cavities are of the same size and shape.

In some implementations, the projecting anchor elements are of the same size and shape.

In some implementations, the assembly further includes:

at least one additional capping board section arranged in end-to-end relation with one of the two capping board sections and defining an additional joint interface therebetween; and the contact bar comprising at least one additional retaining cavity for receiving the projecting anchor element of the additional capping board section, to thereby hold the additional capping board segment and adjacent capping board segment together.

In some implementations, the contact bar comprises at least two contact bar sections and wherein each joint interface of adjacent capping board sections is spanned by the corresponding contact bar section with engagement and cooperation of corresponding projecting anchor elements and retaining cavities, to thereby hold each adjacent pair or capping board segments together by a corresponding contact bar section.

In some implementations, each capping board segment comprises a plurality of retaining pins extending upwardly from at least one side of the capping board segment, and wherein the assembly also comprises a pair of holding bars comprising a plurality of apertures spanning across the joint interface, the aperture being sized and shaped for engaging the retaining pins of the capping board, such that each holding bar also holds the two capping board segments together.

In some implementations, one of the two rows of protrusions is a first row of seats being sized and shaped to receive the hanging arms of the electrodes for insulation thereof, and wherein the other row of protrusions is a second row of protrusions being sized and shaped to provide lateral support to the contact bar.

In some implementations, each capping board segment comprises a dividing wall projecting upwardly from the central elongated channel for division thereof into a primary channel for receiving a primary contact bar, and a secondary channel for receiving a secondary contact bar.

In some implementations, there is provided an assembly comprising:

two adjacent capping board segments arranged in end-to-end relation and defining a joint interface therebetween, each capping board comprising:

a main elongated body;

protrusions extending upwardly from the main elongated body for providing support and electric insulation for hanging arms of electrodes;

an elongated channel extending along the main elongated body; and an engagement element located in the central channel; and a contact bar that is sized and configured to lay on the elongated channel of the two capping boards and to span across the joint interface, the contact bar supporting and providing electrical contact with hanging arms of electrodes, and comprising:

two engagement members provided on opposed sides of the joint interface and being sized and configured to engage respective engagement elements of the two adjacent capping board segments, and cooperating such that the contact bar holds the two capping board segments together.

In some implementations, each engagement element is a projecting anchor element extending upwardly from the central channel.

In some implementations, each engagement member is a retaining cavity and is sized and configured to receive respective projecting anchor elements of the two adjacent capping board segments.

In some implementations, there is provided an assembly comprising:

two adjacent capping board segments arranged in end-to-end relation and defining a joint interface therebetween, each capping board comprising:

a main elongated body;

protrusions extending upwardly from the main elongated body for providing support and electric insulation for hanging arms of electrodes;

an elongated channel extending along the main elongated body; and a contact bar that is sized and configured to lay on the elongated channel of the two capping boards and to span across the joint interface, the contact bar supporting and providing electrical contact with hanging arms of electrodes; and two engagement mechanisms provided on respective sides of the joint interface, each engagement mechanism being configured to longitudinally restrict movement between the contact bar and the corresponding capping board segment.

In some implementations, each engagement mechanism comprises:

a projecting anchor element; and a retaining cavity sized and configured to receive a corresponding projecting anchor element.

In some implementations, the contact bar comprises the projecting anchor elements and the capping board segments comprise the retaining cavities.

In some implementations, there is provided a method of holding together two adjacent capping board segments in end-to-end relation, comprising:

providing an engagement member on an underside of the contact bar;

providing an engagement element on an upper side of each capping board segment; and laying the contact bar along the adjacent capping board segments so as to overlap a joint interface defined in between the adjacent capping board segments and such that the engagement members engage and cooperate with the corresponding engagement elements.

In some implementations, the method employs the contact bar and/or the capping board segments having one or more features as defined herein.

In some implementations, there is provided a method for refining metal in an electrolytic cell including using an assembly having one or more features as defined herein.

In some implementations, there is provided a use of the contact bar and the capping board segments having one or more features as defined herein, in an electrochemical cell for refining metal.

BRIEF DESCRIPTION OF THE DRAWINGS

Embodiments of the capping board and contact bar assembly are represented in and will be further understood in connection with the following figures.

DETAILED DESCRIPTION

While aspects of the capping board and contact bar assembly will be described in conjunction with example embodiments, it will be understood that it is not intended to limit the scope of the invention to such embodiments. On the contrary, it is intended to cover all alternatives, modifications and equivalents as may be included as defined by the present description. The objects, advantages and other features of the present invention will become more apparent and be better understood upon reading of the following non-restrictive description of the invention, given with reference to the accompanying figures.

Figure 13:
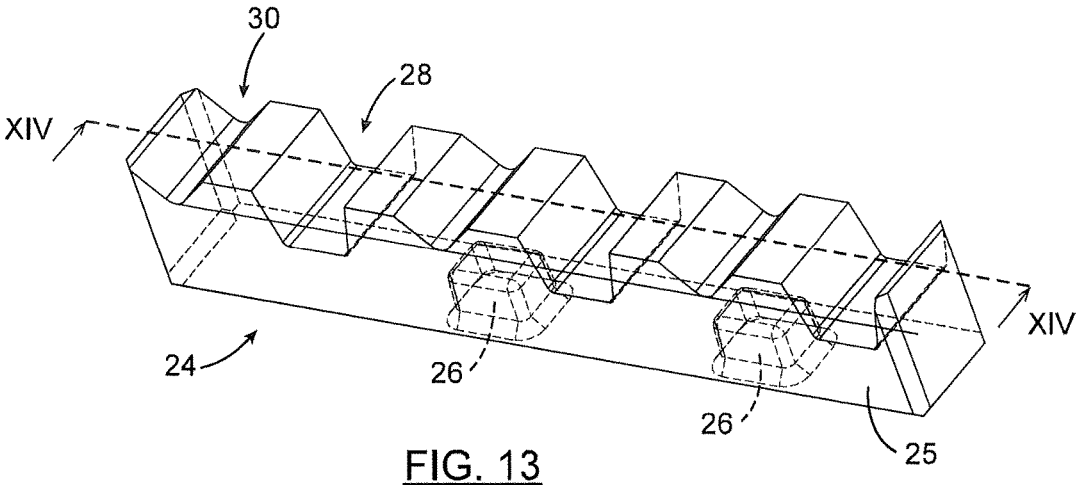
FIG. 13 is a view of a primary contact bar.
Figure 14:
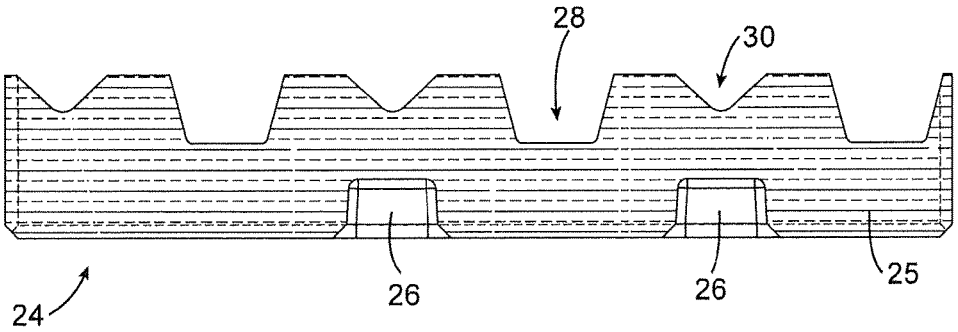
FIG. 14 is a side cross-sectional view along line XIV of FIG. 13.
Figure 15:
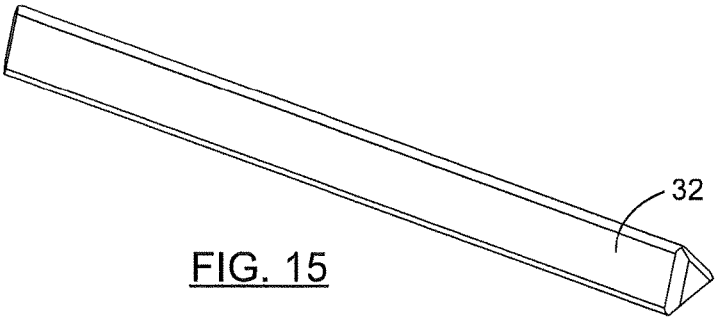
FIG. 15 is view of a secondary contact bar.
Figure 16:
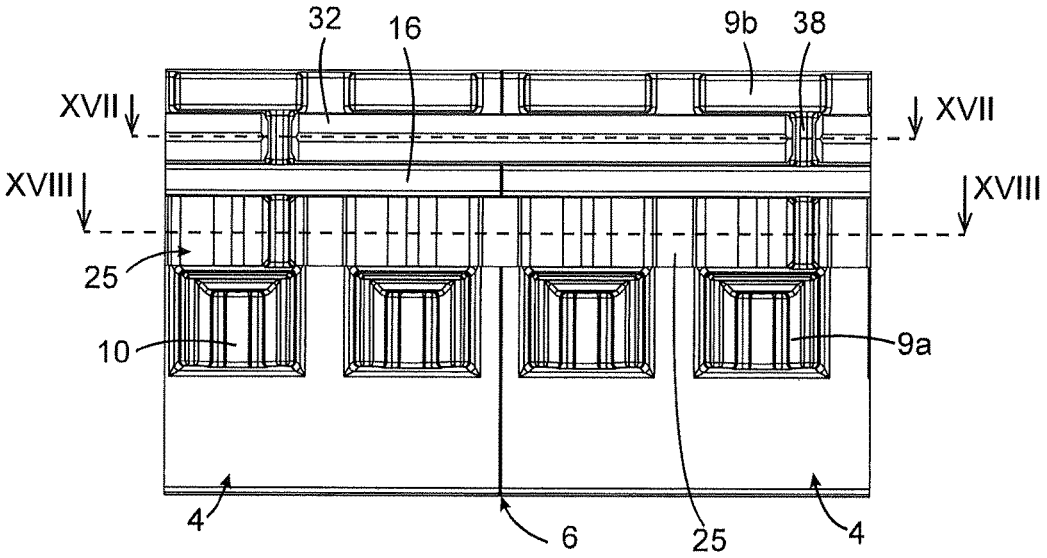
FIG. 16 is a top plan view of a capping board and contact bar assembly.
Figure 17:
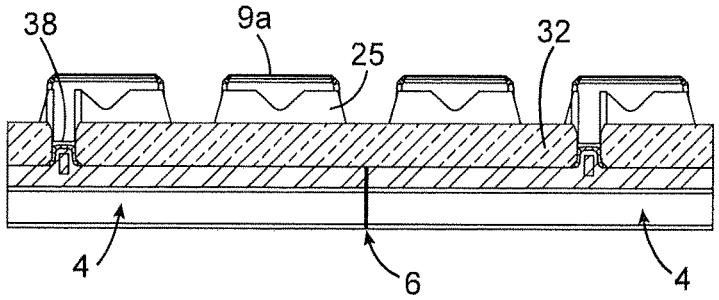
FIG. 17 is a side cross-sectional view along line XVII of FIG. 16.
Figure 18:
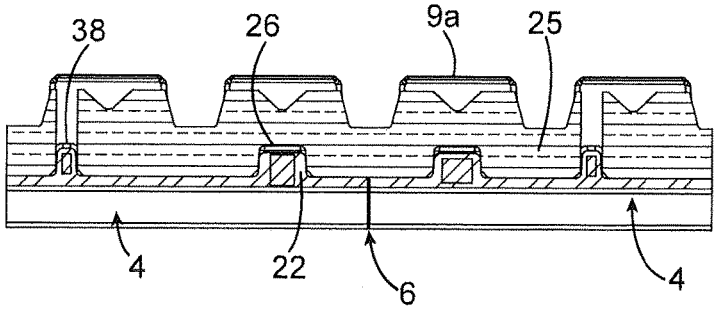
FIG. 18 is a side cross-sectional view along line XVIII of FIG. 16.

FIGS. 1 to 5 illustrate example embodiments of a capping board which includes a plurality of capping board segments. FIGS. 6 to 12 and 16 to 18 illustrate example embodiments of a capping board and contact bar assembly. FIGS. 13 to 15 illustrate example embodiments of an electrolytic cell for refining metals.

The following is a list of elements and associated reference characters that appear in the Figures:

capping board 2
capping board segments 4
common joint interface 6
main elongated body 8
first row of seats 9*a*
second row of protrusions 9*b*
depression 10
central elongated channel 12
lateral channel 14
dividing wall 16
primary channel 18
secondary channel 20
projecting anchor element 22
primary contact bar 24
primary contact bar segment 25
cavity 26, 34
first set of depressions 28
second set of depressions 30
secondary contact bar 32
projection 36
spacing walls 38
pin 40
aperture 42
holding bar 44

To provide a solution to the above mentioned drawbacks, the capping boards of the electrolytic cell may be divided into at least two capping board segments which are, for example, more easily removed and replaced during maintenance operations. As the capping boards are segmented, some aspects of the present invention relate to solutions for holding the capping board segments together.

In one aspect, there is provided a capping board including at least two adjacent capping board segments.

Referring to FIGS. 1 to 5, the capping board 2 includes at least two adjacent capping board segments 4 which are arranged so as to be aligned and have a common joint interface 6. It should be understood that the capping board is not limited to include two capping board segments and may include a plurality of adjacent capping board segments without departing from the scope of the present invention.

Still referring to FIGS. 1 to 5, each capping board segment 4 has a main elongated body 8 and includes first row of seats 9*a* and a second row of protrusions 9*b* extending upwardly from the main elongated body 8. Each of the seats 9*a* provides support for one of the electrodes, which may be symmetrical, by allowing the end of a hanging bar to sit on its upper surface (as better illustrated in FIG. 20). Each of the protrusions 9*b* provides lateral support for a contact bar which rests on the capping board segment. Each protrusion 9*b* may be a support wall and adjacent support walls may be spaced apart to enable sulfuric acid and water to be released during operation of the electrolytic cell. Each seat of the first row of seats 9*a* may include a depression 10 in its upper surface so as to ensure precise placement of the hanging bars of the electrodes. The size and configuration of the seats of the first row may differ from the size and configuration of the protrusions of the opposed second row as illustrated in the appended figures but it should be understood that the seats of the first row and the protrusions of the second row may be identical.

Still referring to FIGS. 1 to 5, the first row of seats 9*a* and second row of protrusions 9*b* may be symmetrically opposed to each other along the main elongated body 8 and spaced apart from each other so as to define a central elongated channel 12 for receiving at least one contact bar laying thereon. Two adjacent seats or protrusions of a same row may be spaced apart from each other so as to define a lateral channel 14 which is sized to fit a corresponding hanging bar of an electrode, such that the hanging bars reach the corresponding contact bar through the lateral channel.

Each capping board segment 4 may further include a dividing wall 16 for dividing the central elongated channel into a primary channel 18 for receiving a primary contact bar and a secondary channel 20 for receiving a secondary contact bar. It should be understood that the primary channel and secondary channel may only be spaced apart from each other to ensure insulation between the primary and secondary contact bars, without the presence of an additional dividing wall.

It should be understood that the two opposed rows of seats and protrusions may be in a symmetrical relationship with each other as illustrated in the appended figures but they may alternatively be in a staggered/offset relationship with each other. Various configurations and spacings are possible depending, for example, on the type of electrolytic cell and the number and arrangement of contact bars to be used. It should also be understood that the protrusions may be seats identical to the first row.

For instance, it should be understood that the central elongated channel is not limited to include a primary channel and a secondary channel, and may include as many channels as needed according to the number of contact bars that are resting on the capping board. For example, the central elongated channel may be a single channel which is sized and shaped to receive one contact bar.

Figure 1:
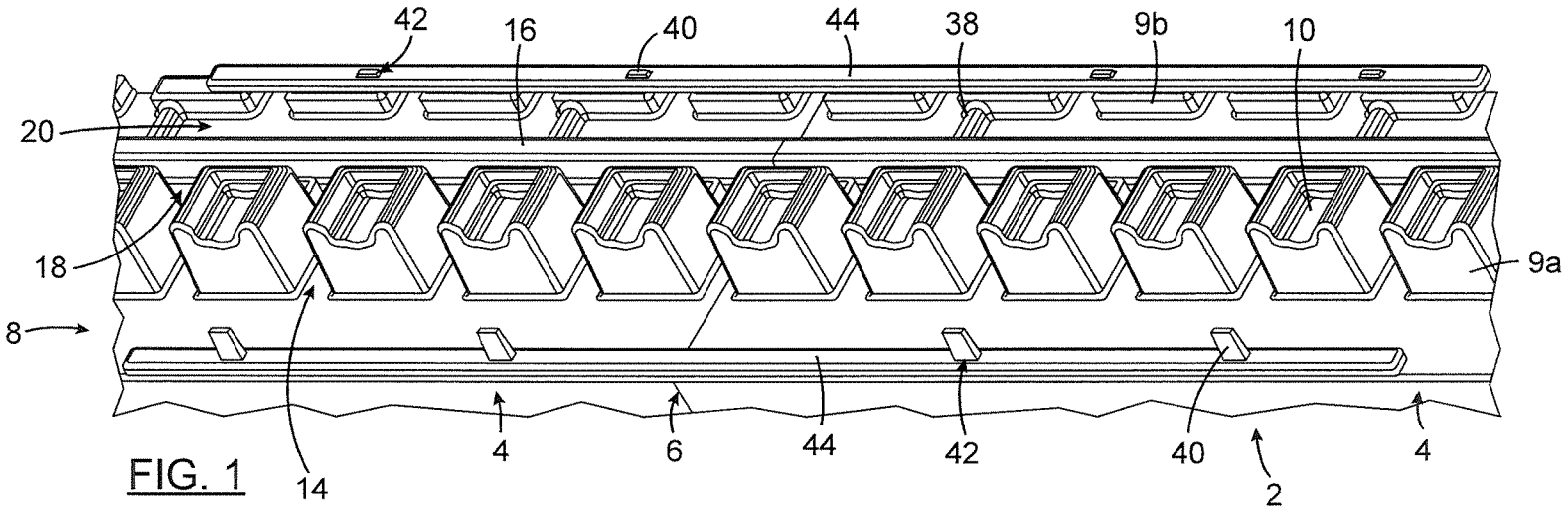
FIG. 1 is a perspective view of two adjacent capping board segments.
Figure 2:
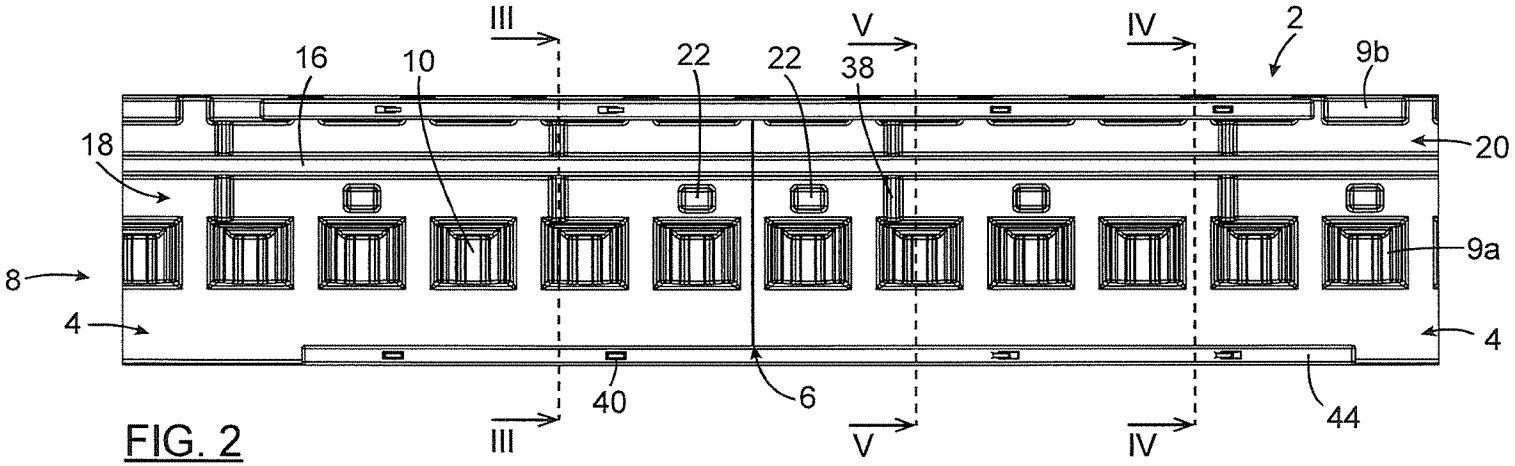
FIG. 2 is a top plan view of two adjacent capping board segments.
Figure 3:
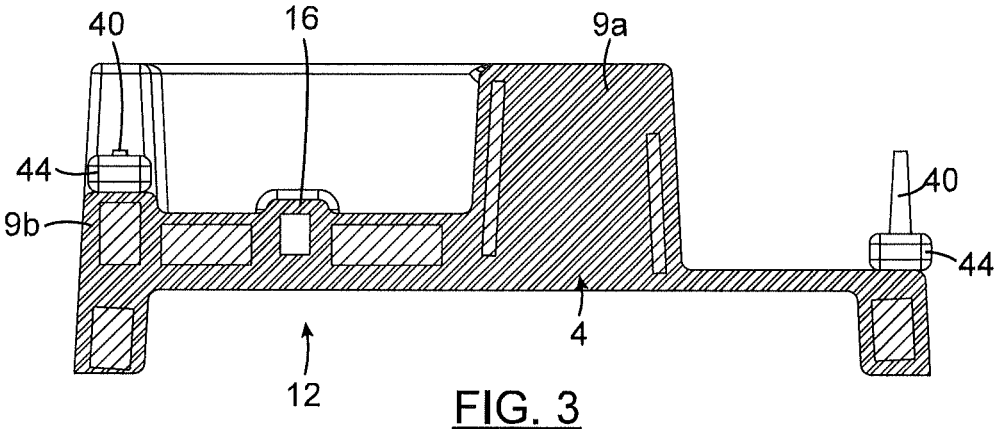
FIG. 3 is a side cross-sectional view along line III of FIG. 2.
Figure 4:
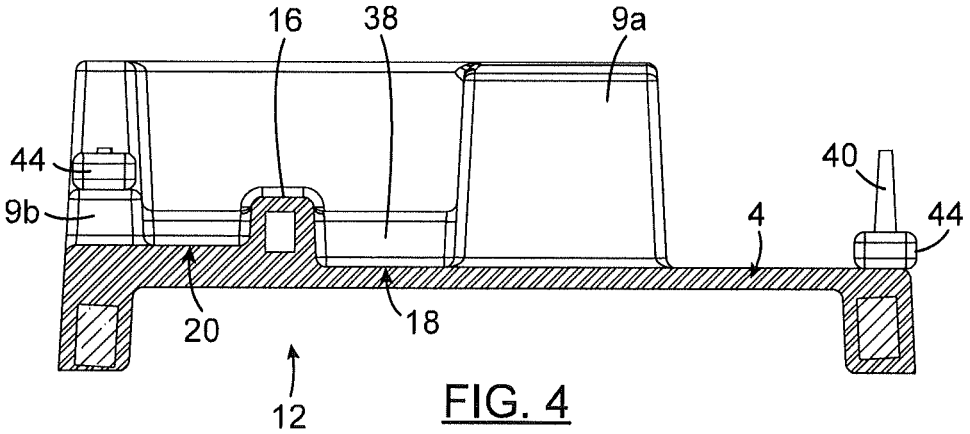
FIG. 4 is a side cross-sectional view along line IV of FIG. 2.
Figure 5:
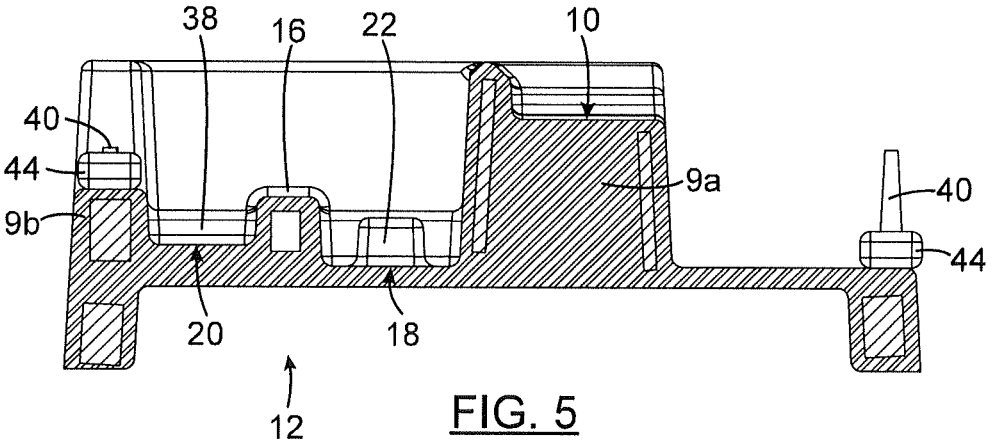
FIG. 5 is a side cross-sectional view along line V of FIG. 2.
Figure 6:
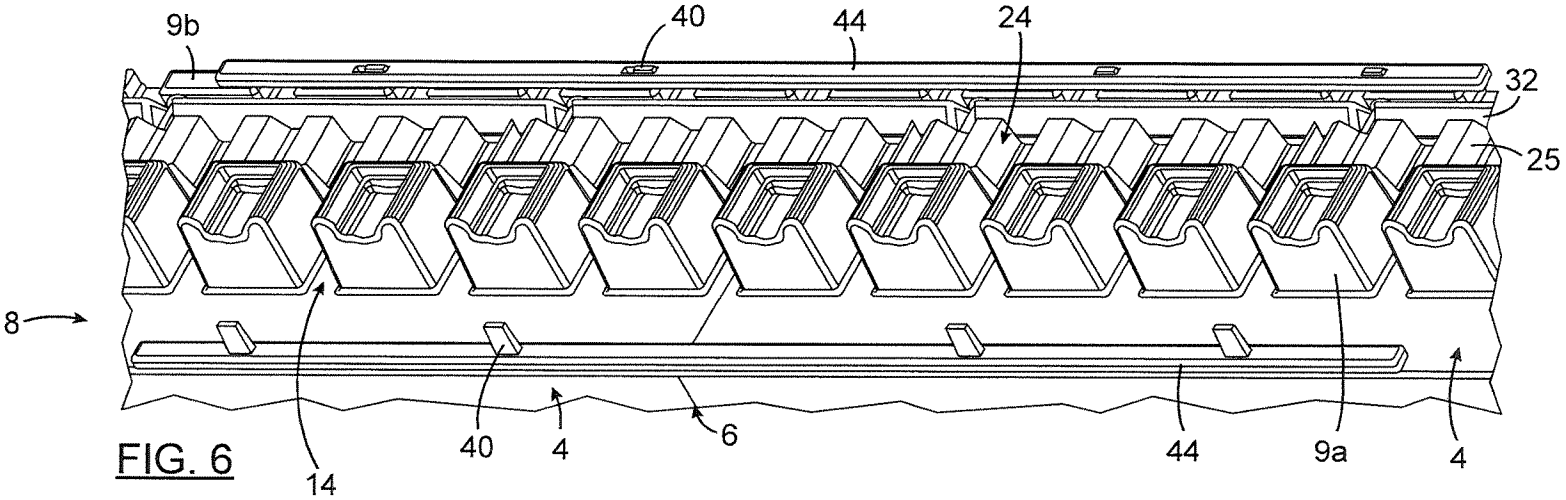
FIG. 6 is a perspective view of a capping board and contact bar assembly.

In some implementations, each capping board segment also includes at least one projecting anchor element cooperating with a contact bar, as will be further explained, to hold the capping board segments together. Referring to FIGS. 2 and 5, each capping board segment 4 includes two projecting anchor elements 22 extending upwardly from the primary channel 18. Each projecting anchor element 22 may optionally be located near an extremity of the capping board segment 4.

It should be noted that a projecting anchor element may be a variety of protrusion, bump, pin, arm or analog thereof which is able to nest, engage or otherwise cooperate with a cavity, aperture or hole that may have a corresponding size and shape, in order to hold the capping board segments together.

In another aspect, there is provided at least one contact bar for holding two adjacent capping board segments together. As mentioned above, the central elongated channel of each capping board segment is sized and configured to receive at least one contact bar, for example a primary contact bar and a secondary contact bar for contact with respective hanging anodes and cathodes.

Referring to FIGS. 13 and 14, the primary contact bar 24 may include at least two cavities 26 projecting inwardly from a lower region of the primary contact bar 24. Optionally, the upper region of the primary contact bar 24 may have a corrugated surface so as to include a first set of depressions 28 and a second set of depressions 30 which are sized and shaped to receive the hanging bars of the electrodes. It should be noted that the first set of depressions 28 are shaped to avoid contact with the hanging bar of the electrode so as to avoid potential short circuits. The first and second series of depressions 28, 30 may be sized and shaped differently with respect to each other. However, it should be understood that all the depressions of the primary contact bar may be the same. Referring to FIG. 15, the secondary contact bar 32 may have a triangular cross-section. Alternatively, the secondary contact bar may have various other sizes and shapes known for refining metals.

It should also be noted that the capping board segments may be held together by various different types of engagement mechanisms that have structures integrated into the capping board segments and overlying contact bars. The engagement mechanisms may include male-female type constructions, such as the projecting anchor elements and retaining cavities that are described and illustrated in detail herein.

In another aspect, there is provided a capping board and contact bar assembly that includes at least one contact bar and at least two adjacent capping board segments.

Figure 19:
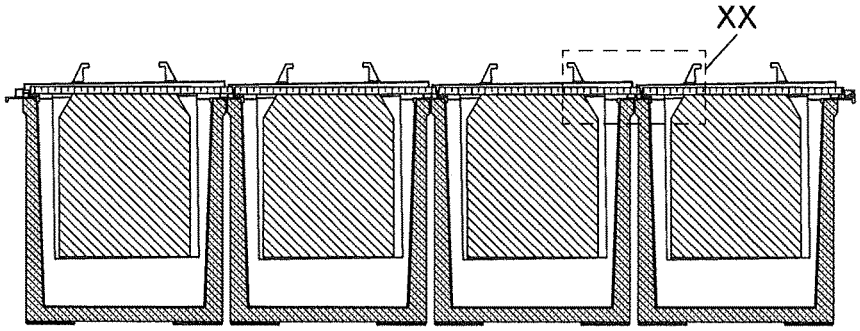
FIG. 19 is a cross-sectional view of adjacent electrolytic cells.
Figure 20:
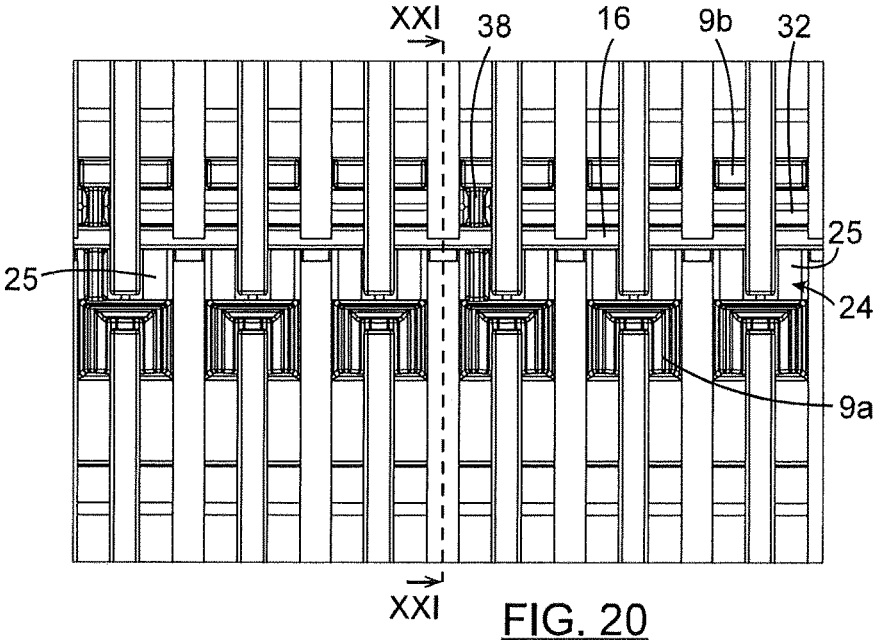
FIG. 20 is a top plan view of the portion XX of FIG. 19.
Figure 21:
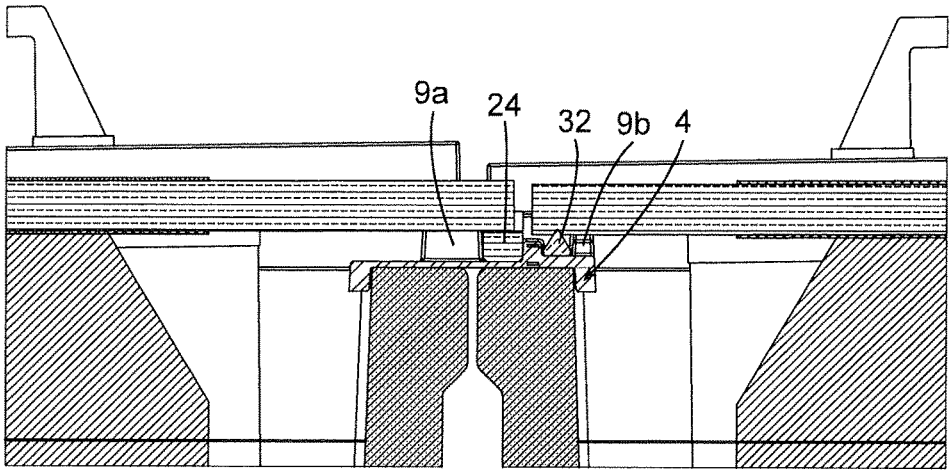
FIG. 21 is a cross-sectional view along line XXI of FIG. 20.
Figure 22:
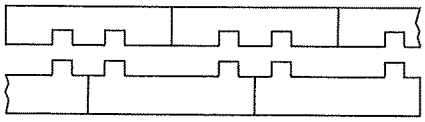
FIG. 22 is a side cut view schematic of contact bar and capping board segments.
Figure 23:
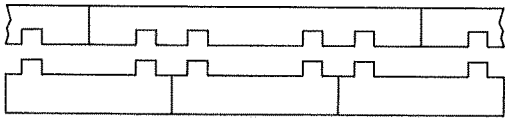
FIG. 23 is another side cut view schematic of contact bar and capping board segments.
Figure 24:
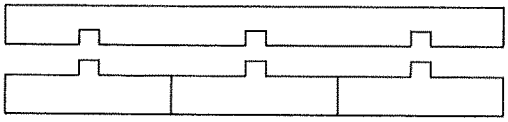
FIG. 24 is another side cut view schematic of contact bar and capping board segments.
Figure 25:
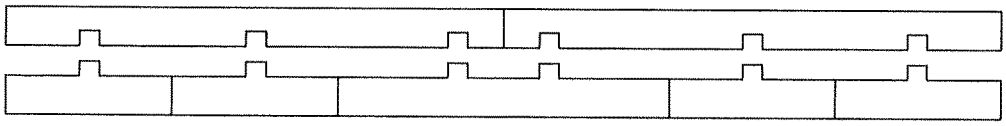
FIG. 25 is another side cut view schematic of contact bar and capping board segments.

Referring to FIGS. 6 to 12, the primary and secondary contact bars 25, 32 are sized and configured such that their lower region fits respectively the primary and secondary channels 18, 20 of the capping board, and such that their upper region performs as a bearing member providing support to and electrical contact with corresponding hanging bars of the electrodes (not illustrated in FIGS. 6 to 12 but in FIGS. 19 to 21). As the primary contact bar 25 rests on the primary channel 18, the at least two cavities 26 of the primary contact bar 25 receive and engage with two consecutive projecting anchor elements 22 of two adjacent capping board segments 4 separated by the common joint interface 6. Such cooperation between two cavities of one contact bar and two projecting anchor elements of two adjacent capping board segments enables the two capping board segments to be held together with one contact bar.

In an optional aspect, the at least one contact bar may include a plurality of contact bar segments. The contact bar segments may be sized and configured such that the central elongated channel of one capping board segment receives several contact bar segments. A single contact bar segment should be provided so as to span the common joint interface of a corresponding pair of adjacent capping board segments, with its retaining cavities engaged with respective projecting anchor elements on either side of the joint interface, to hold the capping board segments together. In this manner, each pair of capping board segments may be held together by a corresponding single contact bar segment, although in other scenarios a single contact bar segment may be used to hold together three or more capping board segments. In addition, some contact bar segments may be provided not spanning a joint interface and may or may not have cavities for cooperating with corresponding projecting anchor elements.

Figure 7:
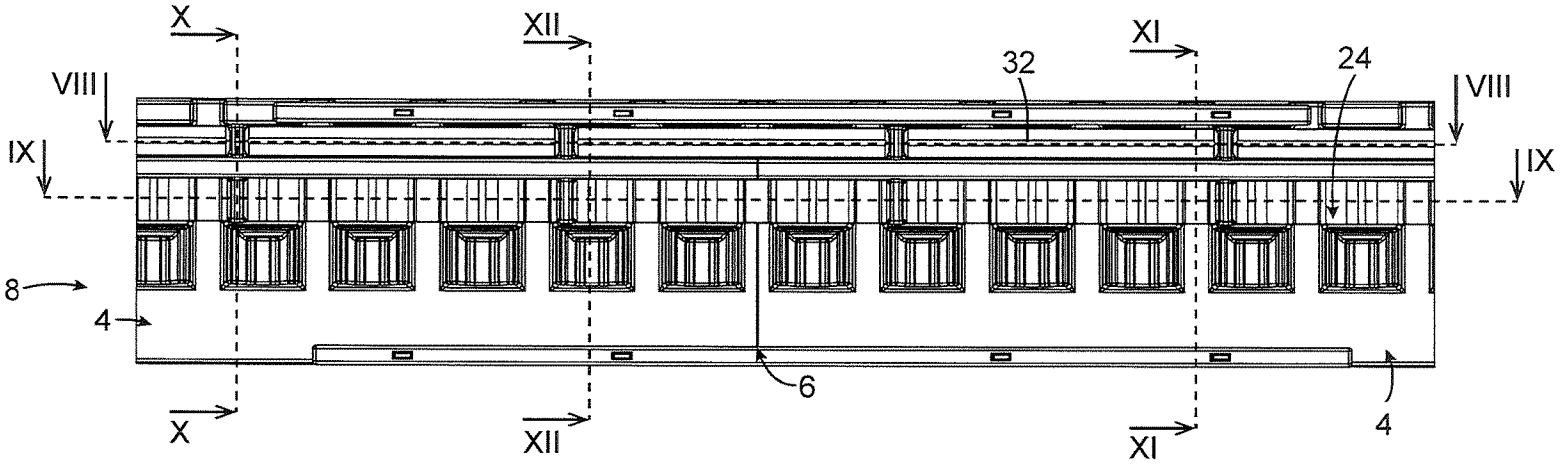
FIG. 7 is a top plan view of a capping board and contact bar assembly.
Figure 8:
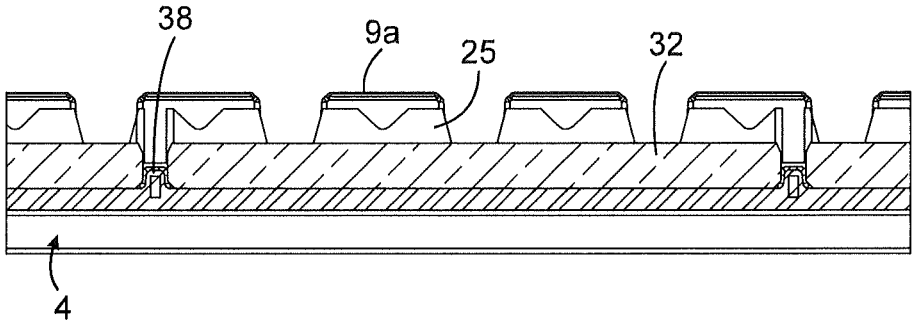
FIG. 8 a side cross-sectional view along line VIII of FIG. 7.

Referring to FIGS. 2 and 7, the primary contact bar 24 may include a plurality of primary contact bar segments 25 that rest along the primary channel 18 of one capping board segment 4. For example, as illustrated, one capping board segment 4 may receive at least two primary contact bar segments 25. It should be understood that two adjacent capping board segments 4 are hold together by one primary contact bar segment 25 by cooperation of the two cavities 26 and projecting anchor elements 22 as described above.

Figure 9:
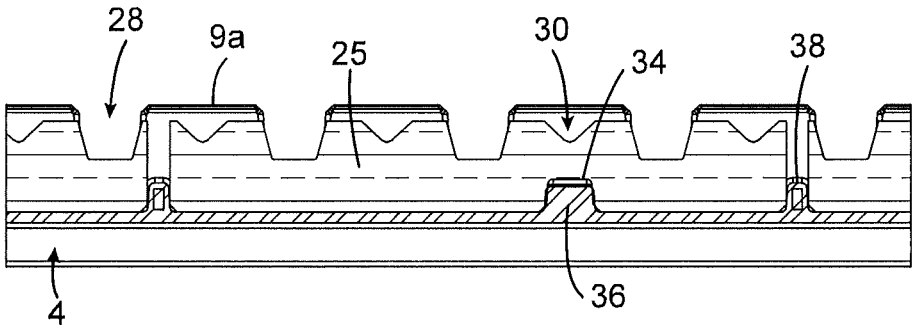
FIG. 9 is a side cross-sectional view along line IX of FIG. 7.

In addition, referring to FIG. 9, the capping board segments 4 may further receive, farther from their joint interface (not illustrated in FIG. 9), one or more adjacent contact bar segments 25 including another cavity 34 which is sized and configured to contain a corresponding projection 36 extending upwardly from the primary channel 18 to enhance stability of the corresponding primary contact bar segment 25 on the primary channel 18. It should be understood that each primary contact bar segment may include one or more other cavity 34 to enhance its stability on the primary channel 18.

Figure 10:
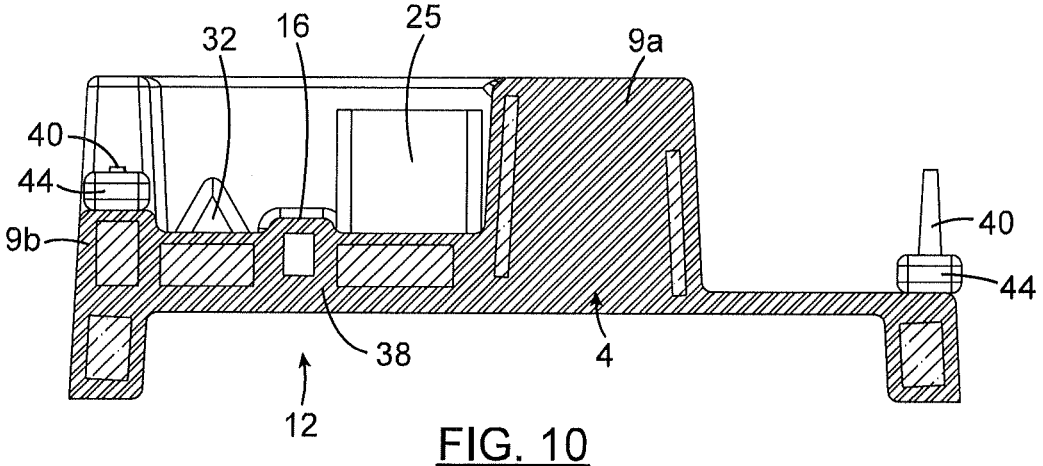
FIG. 10 is a side cross-sectional view along line X of FIG. 7.
Figure 11:
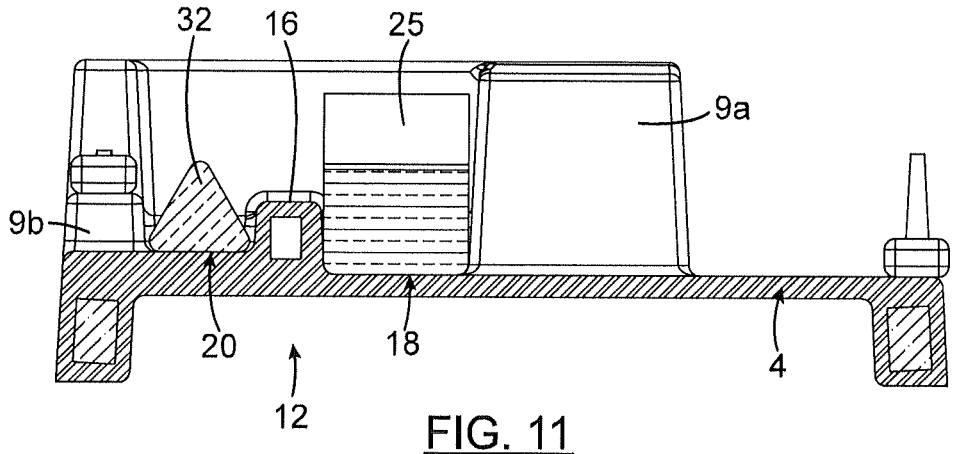
FIG. 11 is a side cross-sectional view along line XI of FIG. 7.
Figure 12:
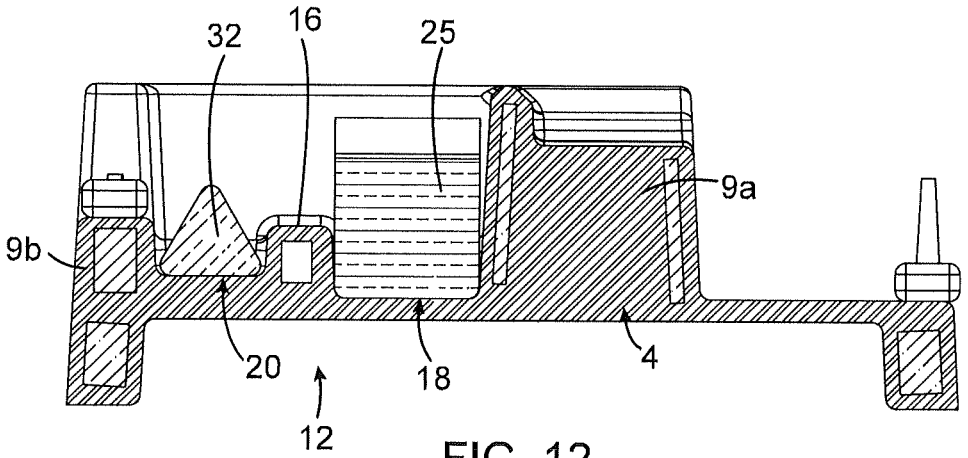
FIG. 12 is a side cross-sectional view along line XII of FIG. 7.

Additionally, referring to FIG. 10, each capping board segment 4 may include a plurality of transverse walls 38, extending upwardly from the central elongated channel insulating one primary contact bar segment 25 from the adjacent contact bar segments 25 so as to reduce propagation of an undesired short-circuit for example.

It should be understood that the capping board segments may include as many transverse walls as needed according to the number of contact bar segments resting on the central elongated channel.

It should further be understood, as illustrated in the Figures, that the secondary contact bar may also include a plurality of secondary contact bar segments which are insulated from one another by similar transverse walls.

In another optional aspect, each capping board segment may include two opposed rows of pins and two corresponding holding bars having apertures for receiving the pins.

Referring to FIGS. 1 to 12, each pin 40 of two opposed rows of pins extends upwardly from either opposed sides of the capping board segment 4. The pins 40 of two adjacent capping board segments are sized and shaped to be inserted in corresponding apertures 42 of a holding bar 44, such that the holding bar 44 further holds the two capping board segments 4 together.

It should be understood that the capping board and contact bar assembly may include a single holding bar that hold the plurality of adjacent capping board segments together. Alternatively, the capping board and contact bar assembly may include a plurality of holding bars, each holding bar holding two adjacent capping board segments together.

In another optional aspect, the capping board segments may include a plurality of reinforcement rods included in the internal structure of the seats, protrusions, pins, dividing wall, transversal walls or a combination thereof.

Figure 26:
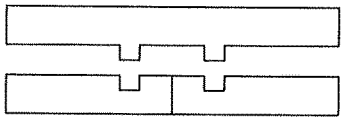
FIG. 26 is another side cut view schematic of contact bar and capping board segments.
Figure 27:
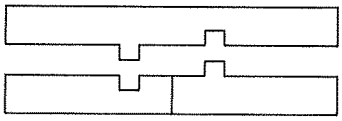
FIG. 27 is another side cut view schematic of contact bar and capping board segments.
Figure 28:
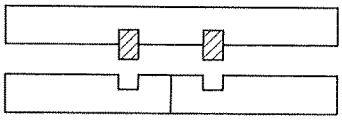
FIG. 28 is another side cut view schematic of contact bar and capping board segments.

Referring to FIGS. 22 to 28, various configurations of the projecting anchor elements and the retaining cavities are illustrated. It should be understood that various different engagement mechanisms may be used in order to hold the capping board segments together. For example, the engagement mechanisms may include male-female type constructions provided on one or the other of the capping board segment and contact bar. The capping board segments may include the male-type projecting anchor elements (as shown in FIGS. 22 to 25) or the female-type retaining cavities (as shown in FIGS. 26 and 28) or both male and female elements (as shown in FIG. 27). The engagement mechanisms may be located at various different points along the assembly, as can be seen in the Figures by way of example.

Figure 29:
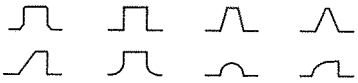
FIG. 29 is a side view schematic of various optional shapes of anchor elements.

Referring to FIG. 29, the engagement mechanisms may have various different shapes that may be symmetrical or not and may have various beveled corners or edges, curvatures, angles, and so on, for retaining the capping board segments together.

It should be understood that any one of the above mentioned optional aspects of each contact bar, capping board, capping board and contact bar assembly and electrolytic cell may be combined with any other of the aspects thereof, unless two aspects clearly cannot be combined due to their mutually exclusivity. For example, the contact bar may be provided with projecting anchor elements instead of cavities, and the capping board segments may be provided with corresponding cavities instead of projecting anchor elements without departing from the scope of the present invention.

The invention claimed is:

1. An assembly comprising:

two adjacent capping board segments arranged in end-to-end relation and defining a joint interface there-between, each capping board comprising:

a main elongated body;

protrusions extending upwardly from the main elongated body for providing support and electric insulation for hanging arms of electrodes;

an elongated channel extending along the main elongated body; and an engagement element located in the central channel; and a contact bar that is sized and configured to lay on the elongated channel of the two capping boards and to span across the joint interface, the contact bar supporting and providing electrical contact with hanging arms of electrodes, and comprising:

two engagement members being sized and configured to engage respective engagement elements provided on opposed sides of the joint interface of the two adjacent capping board segments, and cooperating such that the contact bar holds the two capping board segments together.

2. The assembly of claim 1, wherein each engagement element is a projecting anchor element extending upwardly from the central channel and wherein each engagement member is a retaining cavity that is sized and configured to receive respective projecting anchor elements of the two adjacent capping board segments.

3. The assembly of claim 2, wherein the protrusions are arranged in two opposed rows, the two opposed rows of protrusions being spaced to define a central elongated channel and adjacent protrusions of a same row being spaced apart to define a lateral channel for allowing passage of a corresponding hanging arm of an electrode.

4. The assembly of claim 3, wherein the projecting anchor elements of the capping board segments are located from 1 to 20 centimeters away from the joint interface.

5. The assembly of claim 3, wherein the projecting anchor elements of the capping board segments are located equidistant away from the joint interface.

6. The assembly of claim 3, wherein each of the projecting anchor elements is generally parallelepiped shaped.

7. The assembly of claim 3, wherein each of the projecting anchor elements comprises upper edges and lower edges, the upper edges and/or lower edges being beveled.

8. The assembly of claim 3, wherein each of the retaining cavities has a corresponding shape with respect to the corresponding projecting anchor element engaged therewith.

9. The assembly of claim 3, wherein the retaining cavities are of the same size and shape, and/or the projecting anchor elements are of the same size and shape.

10. The assembly of claim 3, further comprising:

at least one additional capping board section arranged in end-to-end relation with one of the two capping board sections and defining an additional joint interface therebetween;

the contact bar comprising at least one additional retaining cavity for receiving the projecting anchor element of the additional capping board section, to thereby hold the additional capping board segment and adjacent capping board segment together.

11. The assembly of claim 10, wherein the contact bar comprises at least two contact bar sections and wherein each joint interface of adjacent capping board sections is spanned by one contact bar section with engagement and cooperation of corresponding projecting anchor elements and retaining cavities, to thereby hold each adjacent pair or capping board segments together by said one contact bar section.

12. The assembly of claim 3, wherein each capping board segment comprises a plurality of retaining pins extending upwardly from at least one side of the capping board segment, and wherein the assembly also comprises a pair of holding bars comprising a plurality of apertures spanning across the joint interface, the aperture being sized and shaped for engaging the retaining pins of the capping board, such that each holding bar also holds the two capping board segments together.

13. The assembly of claim 3, wherein one of the two rows of protrusions is a first row of seats being sized and shaped to receive the hanging arms of the electrodes for insulation thereof, and wherein the other row of protrusions is a second row of protrusions being sized and shaped to provide lateral support to the contact bar.

14. The assembly of claim 3, wherein each capping board segment comprises a dividing wall projecting upwardly from the central elongated channel for division thereof into a primary channel for receiving a primary contact bar, and a secondary channel for receiving a secondary contact bar.

15. An electrochemical cell for refining metal, the electrochemical cell comprising:

at least two adjacent electrolytic tanks fillable with an electrolytic solution;

first and second opposing rows of electrodes, each electrode being mounted on hanging arms and immersed into the electrolytic solution of one the two adjacent tanks; and the assembly as defined in claim 1, the assembly being mounted about adjacent walls of the two tanks, and the contact bar supporting and providing electrical contact with the hanging arms of the first and second opposing rows of electrodes.

* * * * *